United States Patent [19]

Howard

[11] Patent Number: 4,888,900

[45] Date of Patent: Dec. 26, 1989

[54] MAGAZINE

[76] Inventor: William J. Howard, P.O. Box 573, Wilson, N.C. 27893

[21] Appl. No.: 165,979

[22] Filed: Mar. 9, 1988

[51] Int. Cl.[4] ..... F41C 25/02

[52] U.S. Cl. ..... 42/50

[58] Field of Search ..... 42/7, 18, 22, 50

[56] References Cited

U.S. PATENT DOCUMENTS

| | | | |
|---|---|---|---|
| 1,306,972 | 6/1919 | Nelson | 42/18 |
| 3,619,929 | 11/1971 | Fremont | 42/50 |
| 3,736,686 | 6/1973 | Moller et al. | 42/50 |
| 4,139,959 | 2/1979 | Howard et al. | 42/50 |
| 4,314,419 | 2/1982 | Koon, Jr. | 42/50 |
| 4,472,900 | 9/1984 | Howard | 42/50 |

*Primary Examiner*—Charles T. Jordan

[57] ABSTRACT

A magazine for holding and for reliably feeding cartridge to the chamber of a firearm. The magazine has structure that causes lateral rotation of an advancing cartridge. This moves the tip of the projectile toward the centerline of the magazine. The magazine also has structure which then causes further lateral rotation and raising of the tip of the projectile.

6 Claims, 4 Drawing Sheets

FIG. 3
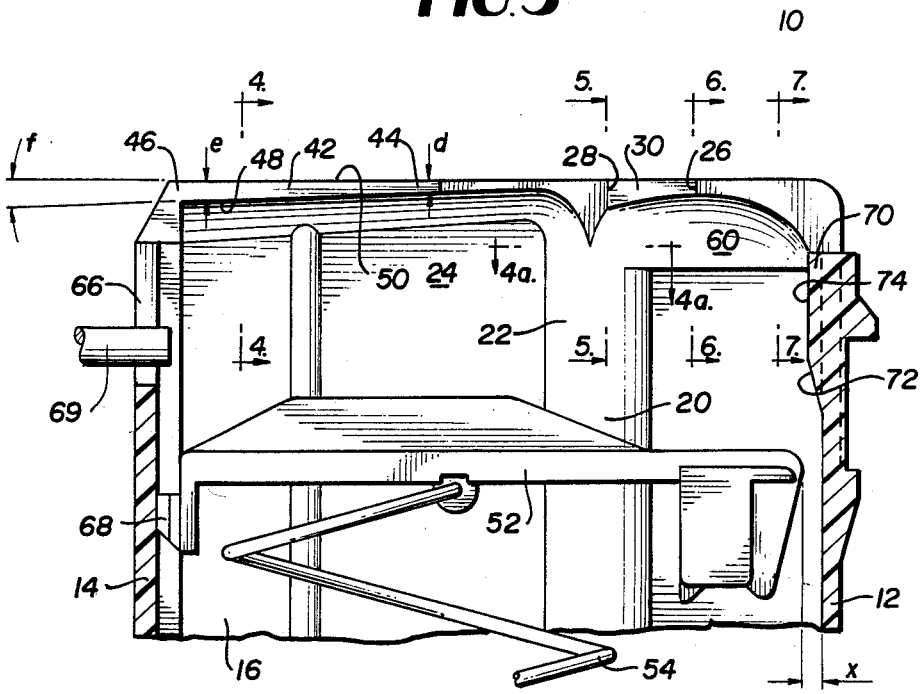
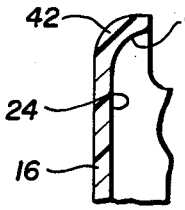
FIG. 4
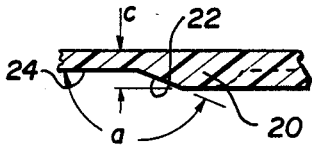
FIG. 4a
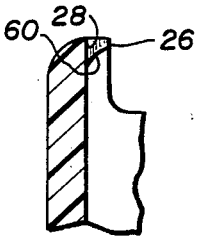
FIG. 5
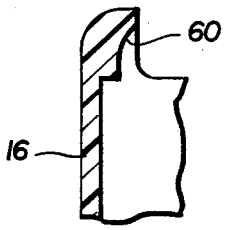
FIG. 6
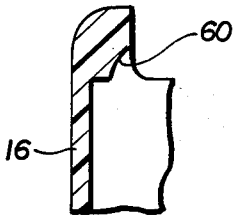
FIG. 7

FIG. 12
PRIOR ART
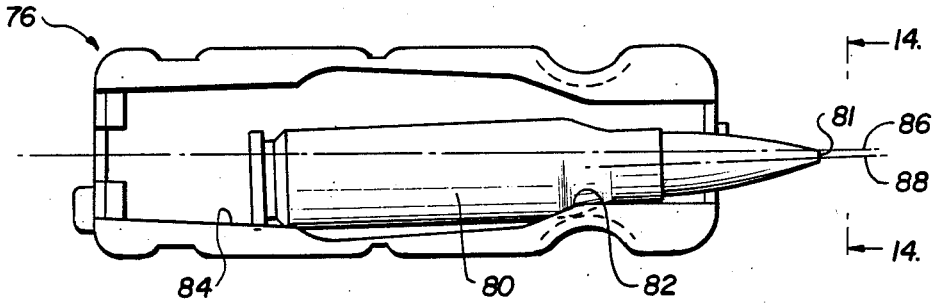
FIG. 13
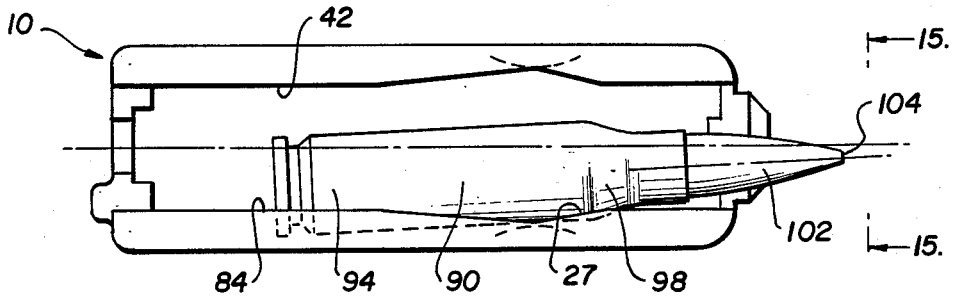
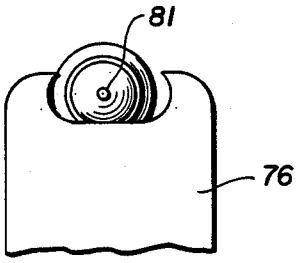
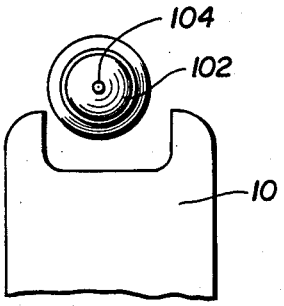
FIG. 14
PRIOR ART
FIG. 15

MAGAZINE

This invention relates to an improved magazine for holding and for feeding projectile-containing cartridges to a firearm.

Magazines are commonly employed to store cartridges and to cooperate with the bolt of a firearm to feed these cartridges to the chamber of the rifle. After insertion into the chamber of the rifle, the cartridges are fired sending the projectile toward the target. In automatic rifles, and in semi-automatic rifles, it is highly desirable that the cartridges be reliably fed to the chamber without jamming. Undesirable jamming can occur in a number of different ways. One common way that jamming can occur is for the tip of the projectile to contact a wall of the chamber thereby stopping the forward movement of the bolt.

In order for the flight of the projectile to be true, it is necessary that the tip of the projectile be free of damage when the projectile leaves the firearm. Many prior magazines cause or permit the tip of the projectile to undesirably contact the wall of the chamber. This contact between the tip of the projectile and the wall of the chamber can cause damage which changes the geometry of the projectile. This change of geometry adversely effects the flight-path of the projectile. Many kinds of damage can occur to the tip of the projectile. It can be flattened or in other cases a burr can be raised on the projectile.

Many semi-authomatic rifles and many automatic rifles are equipped with a bolt-latch operated by a pin. As is well known in the art, the function of the bolt-latch is to prevent the bolt from advancing toward the chamber after the last round has been fired. This is conventionally accomplished by providing the cartridge follower with a bolt-latch actuator. Unfortunately, in many prior magazines, the bolt-latch actuator does not always contact the bolt-latch pin. Failure to contact the pin means that the bolt advances on an empty chamber containing no cartridge. The operator of the firearm must then manually return the bolt. This takes time. When this occurs to a soldier in a combat situation, this loss of time can be dangerous to the soldier and his comrades.

While the above-described problems are present to a greater or lesser degree in all semi-automatic rifles and in all automatic rifles, these problems are particularly prevelent and are particularly troublesome in the so called "FAL" rifle. This rifle is conventionally produced by or under license from Fabrique National of Belgium. This rifle is also frequently known as the "FALFN" rifle. It fire a standard "308 cartridge" having a diameter of 7.62mm This is the standard cartridge for the North Atlantic Treaty Organization (NATO). The same cartridge is also used with the United States Army rifle designated as "M-14".

Accordingly, it is an object of the present invention to provide an improved magazine which is substantially free of one or more of the disadvantages of prior magazines.

Another object of the present invention, is to provide an improved magazine which is substantially, completely jam-proof.

Still another object of the present invention is to provide an improved magazine which feeds a projectile to the chamber of a rifle without damaging the tip of the projectile.

Yet another object of the present invention, is to provide an improved magazine which feeds a projectile to the chamber of a rifle without contact between the tip of the projectile and the walls of the chamber.

An additional object of the present invention is to provide an improved magazine which reliably actuates the bolt-latch after firing the last round in the magazine.

Additional objects and advantages of the present invention will be apparent to those skilled in the art by reference to the following description and drawings wherein:

FIG. 3 is a sectional view taken along line 3—3 of FIG. 2; and

FIG. 4 is a sectional view taken along line 4—4 of FIG. 3; and

Figure 1:
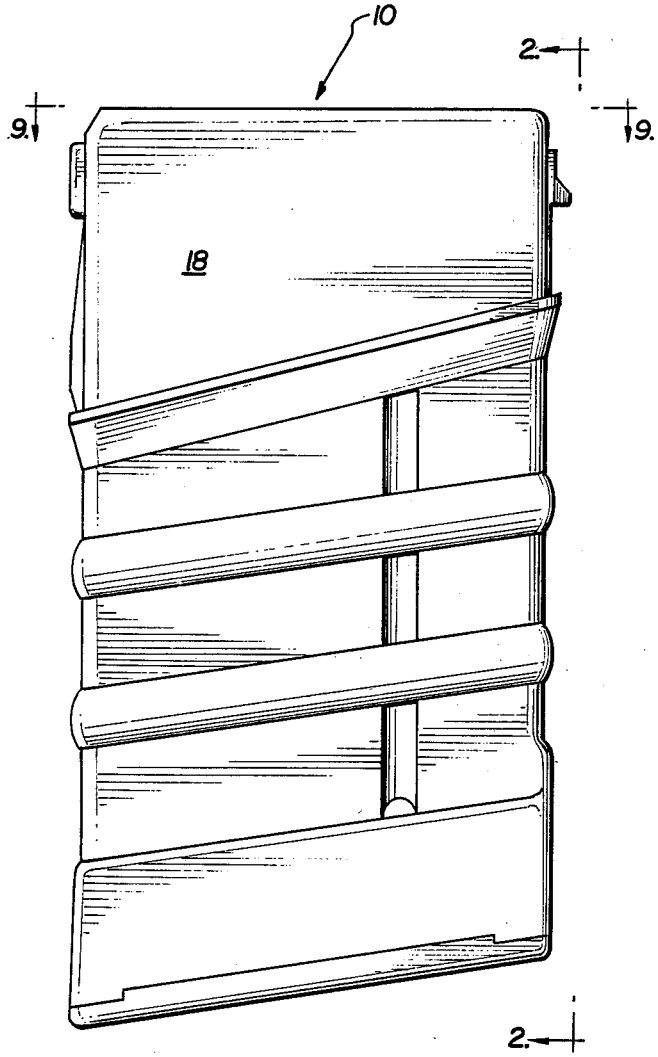
FIG. 1 is an elevation view of a magazine of the present invention.
Figure 8:
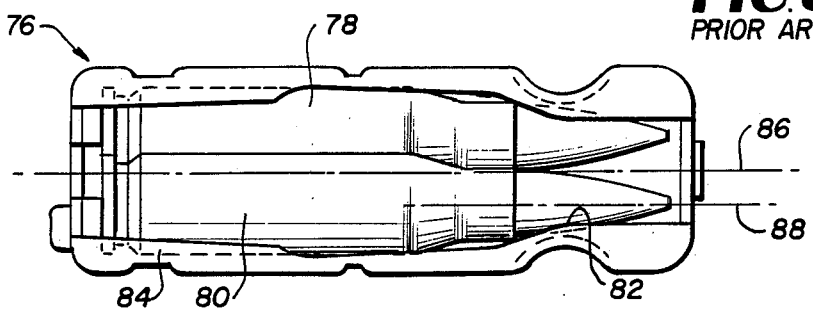
FIG. 8 PRIOR ART
Figure 9:
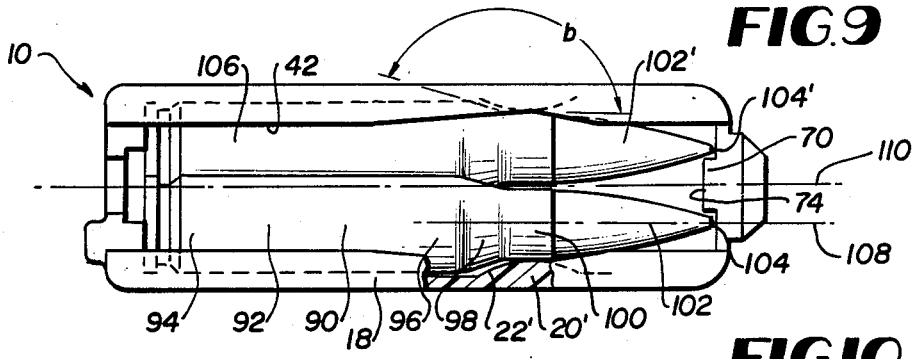
Figure 10:
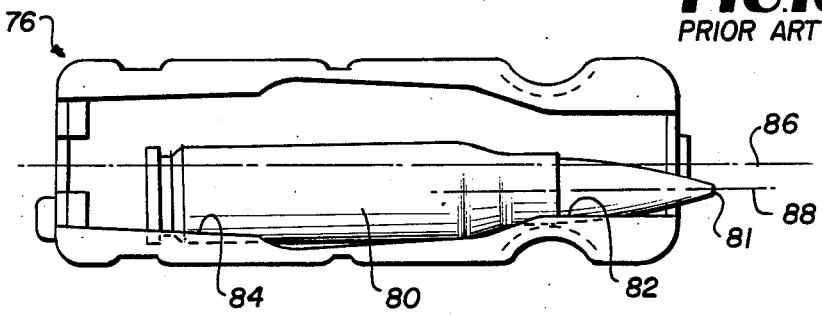
FIG. 10 PRIOR ART
Figure 11:
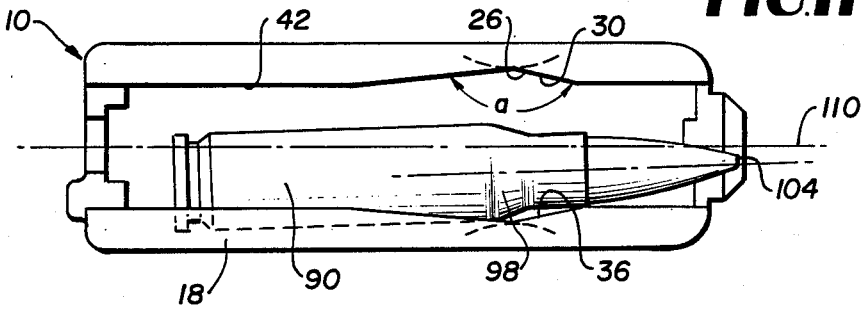

FIG. **4*a* is a sectional view taken along line 4*a*—4*a* of FIG. 3; and FIG. 5 is a sectional view taken along line 5—5 of FIG. 3; and FIG. 6 is a sectional view taken along line 6—6 of FIG. 3; and FIG. 7 is a sectional view taken along line 7—7 of FIG. 3; and FIG. 8 is a top view of a prior art magazine which is not representative of the present invention; and FIG. 9 is top view taken along line 9—9 of FIG. 1; and FIG. 10 is top view of a prior art magazine containing a cartridge which is slightly advanced when compared to the position of the cartridge shown in FIG. 8; and FIG. 11 is a top view similar to that of FIG. 9 but wherein, the cartridge has been advanced from the position shown in FIG. 9 by an amount exactly equal to the amount of advance in the prior art magazine of FIG. 10; and FIG. 12 is a top view of a prior art cartridge not representative of the present invention, wherein, the cartridge has been greatly advanced to a certain point; and FIG. 13 is a top view of the magazine of the present invention, wherein, a cartridge has been advanced an identical amount to that shown in FIG. 12 but wherein the cartridge is in a significantly different position than is the cartridge of FIG. 12; and FIG. 14 is a sectional view taken along line 14—14 of FIG. 12; and FIG. 15 is a sectional view taken along line 15—15 of FIG. 13**.

In accordance with the present invention there is provided a magazine for holding and for reliably feeding cartridges to the chamber of a firearm. The firearm is equipped with a bolt that is used to advance the cartridges to the chamber of a firearm. The magazine comprises means for causing lateral rotation of an advancing cartridge in a horizontal plane. The rotation moves the tip of the projectile toward the centerline of the magazine. The magazine of the present invention also includes means for subsequently causing further lateral rotation of the advancing cartridge and for simultaneously raising the tip of the projectile while slidably holding the rear portion of the body of the cartridge.

According to another embodiment of the present invention, the magazine includes means for positively laterally inwardly rotating any errant cartridge.

In another embodiment of the magazine of the present invention there is provided means for positively, rearwardly urging the bolt-latch actuator.

Figure 2:
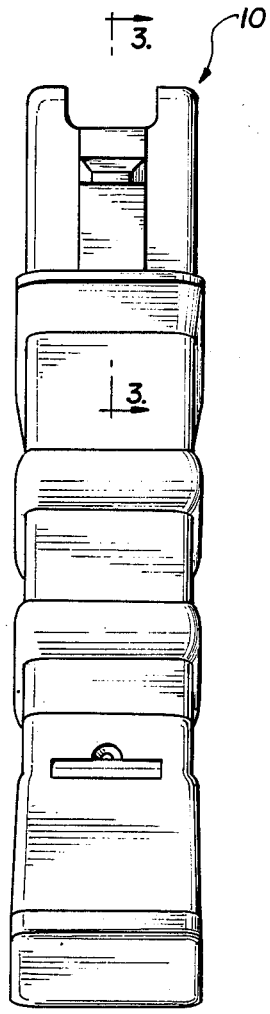
FIG. 2 is a sectional view taken along line 2—2 of FIG. 1.

Referring now to the drawings in general, and in particular to FIGS. 1, 2, and 3 in particular, there is shown a magazine 10 of the present invention. The magazine 10 comprises a front wall 12 and a rear wall 14. A left side wall 16 joins the left side of the front wall 12 to the left side of the rear wall 14. In the magazine 10 a right side wall 18 joins the right side of the front wall 12 to the right side of the rear wall 14.

The magazine 10 also has a left lower shoulder ramp 20. The ramp 20 has a rearwardly facing surface 22. The surface 22 is inclined at an oblique angle "a". The angle "a" is substantially equal to the angle "b" between the body and the shoulder of the cartridge. (see FIG. 9). The maximum height "c" of the ramp 20 from the inside surface 24 of the left side wall 16 is less than the difference between the radius of the neck and the radius of the forward of the body of a cartridge. The right wall 18 has a right lower shoulder ramp 20' (see FIG. 9) the structure of which is the exact mirror image of the structure of the left lower shoulder ramp 20.

The magazine 10 also has a left upper shoulder ramp 26, the outermost portion 28 of which is substantially coincidental with the ramp 20. The ramp 26 has a rearwardly facing surface 30 inclined at an oblique angle "a" substantially equal to the angle "a" between the body and the shoulder of a cartridge (see FIG. 11).

The right side wall 18 is equipped with a right upper shoulder ramp 36, (see FIG. 11), the structure of which is the mirror image of the structure of the left upper shoulder ramp 26.

The magazine 10 also has a left cartridge-retaining lip 42. Its forward portion 44 has a thickness "d" that is less than the thickness "e" of its rear portion 46. The bottom surface 48 forms an angle "f" with the top surface 50 of the magazine 10. The angle "f" is slight but is significant. The angle "f" can be as little as 0.25° or as much as about 5°. A cartridge (not shown) will rest against the bottom surface 48 of the lip 42 and will be held in that position under the influence of the follower 52. The follower 52 is upwardly biased by the spring 54.

The magazine 10 is also provided with a concave surface 60 the structure of which is most clearly shown in FIGS. 3, 5, 6, and 7. The concave surface 60 constitutes means for positively laterally inwardly rotating any errant cartridge.

Referring further to FIG. 3, it can be seen that the rear wall 14 contains a slot 66. The slot 66 is adapted to receive a bolt-latch actuator 68 carried by the follower 52. As is well known in the art, the bolt-latch actuator 68 actuates a bolt-latch pin 69. This actuation takes place when the magazine 10 is empty as the follower 52 rises with the result that the actuator 68 raises the pin 69, provided the actuator 68 is sufficiently rearward. The bolt-latch (not shown) prevents the bolt (not shown) from moving forward on an empty chamber. As can be seen in FIG. 3, the follower 52 is spaced from the front wall 12 if the follower 52 is in the position shown in FIG. 3. This space "x" is about 1.01 to 1.27 mm (0.040 to 0.050 inches). The front wall 12 carries a ramp 70. The ramp 70 has an inclined surface 72 as well as a surface 74 which is parallel to the inside surface of the front wall 12. The inclined surface 72 begins opposite but below the slot 66 in the back wall 14. As the follower 52 rises, its front first contacts the inclined surface 72 and then the surface 74 with the result that the actuator 68 is urged positively rearwardly such that the actuator 68 contacts the bottom of the pin 69 raising it. When the pin 69 is raised, the bolt-latch (not shown) prevents the bolt (not shown) from advancing if there is no cartridge in the magazine 10.

FIG. 8 shows a conventional, prior art magazine 76 which is not representative of the present invention. The prior art magazine 76 contains cartridges 78, 80. The cartridge 80 is held in position by a forward cartridge retaining lip 82 and a rear cartridge retaining lip 84. In the prior art magazine 76 the centerline 86 of the magazine 76 is substantially parallel to the centerline 88 of the cartridge 80.

Referring now to FIG. 9 it can be seen that the magazine 10 holds a right row (not shown) of cartridges the uppermost cartridge 90 of which can be seen. The cartridge 90 has a body 92 having a rear portion 94 and a forward portion 96. A shoulder 98 is attached to the body 92 at its forward portion 96. The cartridge 90 also has a neck 100 attached to the shoulder 98. A projectile 102 is in the neck 100. The projectile 102 has a pointed tip 104. The magazine 10 also holds a left row (not shown) of cartridges the uppermost cartridge 106 of which is shown. All cartridges including the cartridges 78, 80, 90, and 106 have the same structure.

As shown in FIG. 9 the center line 108 of the cartridge 90 is parallel to the center line 110 of the magazine 10. As further shown in FIG. 9 the shoulder 98 is close to but is aft of the surface 22' of the left lower shoulder ramp 20'.

Furthermore, as shown in FIG. 9, an important structural feature of the present invention is that the ramp 70 fits between the projectiles 102 and 102'. Furthermore, the surface 74 is aft of a line between the tips 104, 104'.

Referring now to FIG. 10 there is shown the prior art magazine 76 wherein the cartridge 80 has been advanced by the bolt (not shown) a distance approximately equal to one-eighth ($\frac{1}{8}$) of its overall length. The cartridge 80 is still held in place by the lips 82, 84. Furthermore the centerline 88 of the cartridge 80 is still approximately parallel to the centerline 86 of the magazine 76.

Referring now to FIG. 11 it can be seen that in the magazine 10 of the present invention the cartridge 90 is in a slightly different position. This slightly different position is of great importance. As soon as the cartridge 90 begins to advance forwardly toward the chamber, the shoulder 98 of the cartridge 90 contacts the surface 22' of the ramp 20'. This causes inward rotation of the cartridge 90 moving the tip 104 closer to the centerline 110 of the magazine 10. The rotation of the cartridge 90 is substantially completely in a plane defined by its centerline 108 and the centerline 110 of the magazine. The rotation is counterclockwise because the cartridge 90 comes from the right hand row of cartridges. In the case of cartridge 106 or any cartridge coming from the left hand row of cartridges, the rotation of the tip 104' will be clockwise. Comparing FIGS. 10 and 11 it can be seen that the tip 104 of the cartridge 90 in the magazine 10 of the present invention is closer to the centerline 110 of the magazine 10 than is the tip 81 in the case of the prior art magazine 76 shown in FIG. 10. This is true even though the amount of advance of the cartridges 80, 90 is identical.

Referring now to FIG. 12 there is shown the prior art magazine 76 wherein the cartridge 80 has been advanced an amount further than was the case in FIG. 10. As shown in FIG. 12 the centerline 88 of the cartridge 80 is still substantially parallel to the centerline 86 of the magazine 76. Furthermore the cartridge 80 is still securely held by the lips 82, 84.

Referring now to FIGS. 13 and 15, additional important differences can be seen even though the amount of advance of the cartridge 90 the magazine 10 of the present invention is substantially equal to the amount of advance of the cartridge 80 in the prior art magazine 76 shown in FIG. 12. As shown in FIG. 15, the tip 104 has been elevated.

As shown in FIG. 13 as the cartridge 90 continues to advance forwardly toward the chamber (not shown) the shoulder 98 contacts the right upper shoulder ramp 36 while upward movement of the rear portion 94 the cartridge 90 is prevented because of contact of the rear portion 94 with the cartridge retaining lip 84. This causes further inward rotation of the cartridge 90 and also simultaneously causes upward rotation of the cartridge 90 all of which results in raising the tip 104 of the projectile 102. In this position, the tip 104 of the projectile 102 is substantially aligned with the centerline (not shown) of the chamber (not shown).

By virtue of the structure of the magazine 10 of the present invention, each cartridge such as the cartridge 90 reliably enters the chamber (not shown) without jamming and without contact between the tip 104 of the projectile 102 with the walls (not shown) of the chamber (not shown).

As used herein, the terms forward, and forwardly refer to the direction of the target. The forward direction is from left to right on all sheets of drawings. Similarly, the terms rear, rearwardly and aft mean away from the target, namely, from right to left on each sheet of drawings.

An important feature of the present invention is the fact that the magazine 10 is constructed of an organic plastic. The plastic can be thermosetting or thermoplastic. A wide variety of plastics can be employed if they have the proper physical properties of strength, resilience, and toughness. Plastics such as polyesters, polyamides and polyolefins such as polyethylene or polypropylene, are potential candidates. The preferred material is a fiber-filled nylon sold by the Dupont Chemical Company under the tradename ZYTEL.

The magazine 10 of the present invention is optionally provided with a additional structure as shown in Howard et al U.S. Pat. No. 4,139,959 issued Feb. 20, 1979, the entire disclosure of which is incorporated herein by reference.

The magazine 10 of the present invention can also be provided with a telescoping section as disclosed and claimed in Howard U.S. Pat. No. 4,472,900 issued Feb. 25, 1984.

In accordance with the present invention, as the cartridge 90 advances further from the position shown in FIGS. 13 and 15, the lip 84 continues to hold the cartridge 90 while the tip 104 is raised further. In accordance with the present invention the cartridge 90 is thrown into the chamber (not shown) without contact between the tip 104 and the walls (not shown) of the chamber (not shown). This is completely different than in the case of the pior art magazine 76.

Although the invention has been described in considerable detail with reference to a preferred embodiment thereof, it will be apparent to those skilled in the art that the present invention can be modified without departing from the spirit and scope of the invention as described above and as defined in the appended claims.

What is claimed is:

1. A magazine for holding a plurality of cartridges in two adjacent parallel rows, and for feeding these cartridges sequentially to a firearm equipped with a bolt-latch pin, which, when actuated, will prevent the bolt from closing on an empty chamber; said magazine comprising:

A. a rear wall having a slot therein; and

B a front wall having a ramp thereon, wherein the ramp fits between the parallel rows of cartridges; and C. an upwardly biased follower carrying at its rear, a bolt-latch actuator; and D. wherein the follower fits between the front wall and the rear wall when the follower is below the ramp; and E. wherein, when the follower is opposite the ramp, the ramp urges the follower rearwardly such that the bolt latch actuator contacts the bolt-latch pin in the slot in the rear wall.

2. The magazine of claim 1 constructed substantially completely of thermoplastic.

3. The magazine of claim 2, wherein the thermoplastic is nylon.

4. The magazine of claim 2, wherein the thermoplastic is polypropylene.

5. A magazine for holding and for reliably feeding cartridges to the chamber of a firearm equipped with a bolt by advancing the cartridge comprises:

A. a body having a rear portion and a forward portion; and

B. a shoulder attached to the body; and

C. a neck attached to the shoulder; and

D. a projectile in the neck wherein the projectile has a pointed tip;

E. said magazine comprising:

F. a front wall; and

G. a rear wall; and

H. a left side wall joining the left side of the front wall to the left side of the rear wall; and I. a right side wall joining the right side of the front wall to the right side of the rear wall; and J. a left lower shoulder ramp carried by the left side wall; and K. a left lower shoulder ramp having a rearwardly facing inclined surface; and L. a right lower shoulder ramp carried by the right side wall; and M. wherein the right lower shoulder ramp has a rearwardly facing inclined surface; and N. a left upper shoulder ramp, the outer most portion of which is substantially coincidental with the left lower shoulder ramp; and O. wherein the left upper shoulder ramp has a rearwardly facing inclined surface; and P. a right upper shoulder ramp the outermost portion of which is substantially coincidential with the right lower shoulder ramp; and Q. wherein the right upper shoulder ramp has a rearwardly facing inclined surface; and R. wherein each cartridge reliably enters the chamber without jamming and without contact between the tip of the projectile with the walls of the chamber.

6. A magazine for holding cartridges in a right-hand stack and in a left-hand stack and for reliably feeding cartridges to the chamber of a firearm equipped with a bolt by advancing the cartridges to the chamber:

wherein each cartridge comprises:

A. a body having a rear portion and a forward portion; and

B. a shoulder attached to the body; and

C. a neck attached to the shoulder; and

D. a projectile in the neck wherein the projectile has a pointed tip;

E. said magazine comprising:

F. a front wall; and

G. a rear wall; and

H. a left side wall joining the left side of the front wall to the left side of the rear wall; and I. a right side wall joining the right side of the front wall to the right side of the rear wall; and J. a left lower shoulder ramp carried by the left side wall; and K. a left lower shoulder ramp having a rearwardly facing surface inclined at an oblique angle substantially equal to the angle between the body and the shoulder of the cartridge; and L. wherein the maximum height of the left lower shoulder ramp from the inside surface of the left side wall is less than the difference between the radius of the neck and the radius of the forward portion of the body of the cartridge; and M. a right lower shoulder ramp carried by the right side wall; and N. wherein the right lower shoulder ramp has a rearwardly facing surface inclined at an oblique angle substantially equal to the angle between the body and the shoulder of the cartridge; and O. wherein the maximum height of the right lower shoulder ramp from the inside surface of the right side wall is less than the difference between the radius of the neck and the radius of the forward portion of the body of the cartridge; and P. a left upper shoulder ramp, the outer most portion of which is substantially coincidental with the left lower shoulder ramp; and Q. wherein the left upper shoulder ramp has a rearwardly facing surface inclined at an oblique angle substantially equal to the angle between the body and the shoulder of the cartridge; and R. a right upper shoulder ramp the outer most portion of which is substantially coincidential with the right lower shoulder ramp; and S. wherein the right upper shoulder ramp has a rearwardly facing surface inclined at an oblique angle substantially equal to the angle between the body and the shoulder of the cartridge; and T. wherein as soon as the cartridge begins to advance forwardly toward the chamber, the shoulder of the cartridge contacts a rear shoulder ramp causing inward rotation of the cartridge substantially completely in the plane defined by its center line and the center line of the top of the magazine; and U. wherein the rotation is counter clockwise when the cartridge comes from the right-hand stack of cartridges; and V. wherein the rotation is clockwise when the cartridge comes from the left-hand stack of cartridges; and W. wherein as the cartridge continues to advance forwardly toward the chamber, the shoulder of the cartridge contacts an upper shoulder ramp while upward movement of the rear portion of the cartridge is prevented because of contact of the rear portion of the cartridge with a cartridge-retaining lip; thereby causing further inward rotation of the cartridge and also simultaneously causing upward rotation of the cartridge all of which results in raising of the tip of the projectile such that it is substantially aligned with the center line of the chamber; and X. wherein each cartridge reliably enters the chamber without jamming and without contact between the tip of the projectile with the walls of the chamber.

* * * * *

UNITED STATES PATENT AND TRADEMARK OFFICE

CERTIFICATE OF CORRECTION

PATENT NO. : 4,888,900

DATED : Dec. 26, 1989

INVENTOR(S) : HOWARD

It is certified that error appears in the above-identified patent and that said Letters Patent is hereby corrected as shown below:

Col. 6, Line 29, delete "cartridge comprises:" and insert

--cartridges to the chamber:
wherein each cartridge comprises:--

Signed and Sealed this

Twenty-first Day of January, 1992

*Attest:*

*Attesting Officer*

HARRY F. MANBECK, JR.

*Commissioner of Patents and Trademarks*